United States Patent [19]

Iwamoto et al.

[11] Patent Number: 5,065,995

[45] Date of Patent: Nov. 19, 1991

[54] SHEET SUPPLYING DEVICE

[75] Inventors: Ken Iwamoto, Nara; Atsushi Narukawa, Koriyama, both of Japan

[73] Assignee: Sharp Kabsuhiki Kaisha, Osaka, Japan

[21] Appl. No.: 521,693

[22] Filed: May 10, 1990

[30] Foreign Application Priority Data

May 16, 1989 [JP] Japan ..... 1-122496

[51] Int. Cl.[5] ..... B65H 3/44

[52] U.S. Cl. ..... 271/9; 271/241; 271/164

[58] Field of Search ..... 271/145, 147, 166, 164, 271/241, 171, 9; 355/311

[56] References Cited

U.S. PATENT DOCUMENTS 4,109,246 2/1980 Sasuga ..... 355/311

FOREIGN PATENT DOCUMENTS 56-59245 5/1981 Japan .
31834 2/1983 Japan ..... 271/9
59-123859 7/1984 Japan .
56741 4/1985 Japan ..... 271/9
262735 12/1985 Japan ..... 271/241
206748 9/1986 Japan ..... 355/311

*Primary Examiner*—H. Grant Skaggs
*Attorney, Agent, or Firm*—David G. Conlin; Robert M. Asher

[57] ABSTRACT

A sheet supplying device supplies a sheet to a sheet supplied apparatus which designates the size and transport direction of the sheet. The sheet supplying device includes a movable cassette for placing the sheet thereon and movable to at least two transport positions so as to transport the sheet therefrom in at least two transport directions, a fixed cassette for placing the sheet thereon and fixed in one transport position so as to transport the sheet therefrom in one transport direction, a transport device for transporting the sheet from each of the movable cassette and the fixed cassette to the sheet supplied apparatus. The sheet supplying device further includes a control device, to which the size of the sheet placed on the movable cassette and the size and transport direction of the sheet placed on the fixed cassette are input, for selecting preferentially the fixed cassette as the cassette from which the sheet is transported by the transport device when the size of the sheet placed on the movable cassette corresponds to the designated size and, at the same time, the size and transport direction of the sheet placed on the fixed cassette correspond to the designated size and transport direction.

10 Claims, 8 Drawing Sheets

SHEET SUPPLYING DEVICE

BACKGROUND OF THE INVENTION

1. Field of the Invention

The present invention relates to a sheet supplying device for use in a copier, a printer and the like.

2. Description of the Related Art

An apparatus supplied with a sheet material, for example, a copier which is supplied with copying sheets, such as paper, is provided with a sheet supplying device. The sheet supplying device is provided with a plurality of sheet supplying cassettes with each cassette corresponding to a plurality of sizes of the sheet. A lateral transport for transporting a sheet in the direction of its width is more preferable in view of the transport speed than a longitudinal transport for transporting a sheet in its longitudinal direction. There exists a copier which enables the lateral transport of even large-sized sheets such as B4- and A3-sized sheets.

On the contrary, in order to transport such a large-sized sheet in the lateral direction, it is required that the photoconductive drum, the transport roller, the transport path, etc. in the copier are also large, resulting in the increase of size and cost of the copier. Therefore, a method is preferably used for transporting a large-sized sheet, such as B4-, A3-sized sheets, in the longitudinal direction, while transporting a small-sized sheets, such as sheets of not larger than A4-size, in the lateral direction.

However, in the case, for example, where the copier has a variable magnification function for reducing or enlarging an image, the copier needs B5R- and A4R-sheet cassettes for a longitudinal transport in a reduction copying operation, and further needs B5- and A4-sheet cassettes for a lateral transport in a normal copying operation in consideration of the transport speed. If such various types of cassettes are used in the copier, it is required that the sheet supplying device shall be large to accommodate all of those cassettes, or that one of those cassettes shall be selected and exchanged at the sheet supplying device according to the purpose of each copying operation. As a result, this makes the copier large and thus increases the cost, or complicates the copying operation and thus increases the operation time.

Thus, in order to solve the above problem, a conventional sheet supplying device has been proposed, wherein a common cassette is used for supplying a same sized sheet in two different transport directions, for example, a common cassette for B5 and B5R and a common cassette for A4 and A4R are used, and the switching between the lateral transport and the longitudinal transport is done by turning the cassette, as disclosed in the Japanese Patent Application Laying Open (KOKAI) No. 56-59245, No. 59-123859, etc.

However, in the above conventional supplying device, in case that the same sized sheets are stacked in both a turning cassette, which is capable of turning between a longitudinal transport position for transporting the sheet in the longitudinal direction and a lateral transport position for transporting the sheet in the lateral direction, and a fixed cassette, which is fixed at either the longitudinal transport position or the lateral transport position, when a sheet of this same size is selected, it is not considered which cassette should be selected for supplying the sheet therefrom in view of a smooth and flexible operation of the copier. Therefore, it has been desired to develop a device capable of setting the proper order for selecting a cassette.

SUMMARY OF THE INVENTION

An object of the present invention is to provide a sheet supplying device in which a flexible state, with respect to the selection of the size and transport direction of the sheet to be supplied, can be maintained for a long period.

According to the present invention, the above object can be achieved by a sheet supplying device for supplying a sheet to a sheet supplied apparatus which designates the size and transport direction of the sheet. The sheet supplying device includes a movable sheet placing means having a plane for placing the sheet thereon and movable to at least two transport positions so as to transport the sheet therefrom in at least two transport directions, a fixed sheet placing means having a plane for placing the sheet thereon and fixed in one transport position so as to transport the sheet therefrom in one transport direction, and a transport device for transporting the sheet from each of the movable sheet placing means and the fixed sheet placing means to the sheet supplied apparatus. The sheet supplying device further includes a control device, to which the size of the sheet placed on the movable sheet placing means and the size and transport direction of the sheet placed on the fixed sheet placing means are input, for selecting the fixed sheet placing means as the sheet placing means from which the sheet is transported by the transport device when the size and transport direction of the sheet placed on the fixed sheet placing means correspond to the designated size.

According to the above sheet supplying device, for example, in case of supplying a sheet such as a sheet of paper to the sheet supplied apparatus such as a copier, when a supply of A4R sheet (A4-sized sheet in a longitudinal direction) is designated, if there are a fixed sheet placing means A4R sheets, and a movable sheet placing means placing A4-sized sheets, the control device selects the fixed sheet placing means, and then the sheet is transported from the fixed sheet placing means by the transport device to the sheet supplied apparatus.

On the contrary to the present invention, if the sheet would be transported from the movable sheet placing means in the above example, the movable sheet placing means would become empty after a certain amount of copying operation, and at this stage, even if the A4 (A4-sized in a lateral direction) would be designated, either the movable sheet placing means (which is empty) or the fixed sheet placing means (A4R sheet is placed) could not supply this designated sheet, which condition would remain until the movable sheet placing means is filled again with the A4-sized sheet. Thus, the flexibility with respect to the selection of the size and transport direction of the sheet would be reduced in this case.

On the other hand, according to the present invention as described above, since the fixed sheet placing means is used for supplying the sheet prior to the movable sheet placing means, even when the fixed sheet placing means becomes empty, the sheet supplying device still can supply both A4R sheet and A4 sheet, by use of the movable sheet placing means.

As described above, a flexible state, with respect to the selection of the size and transport direction of the sheet to be supplied, can be maintained for a long period in the sheet supplying device according to the present invention.

DETAILED DESCRIPTION OF THE PREFERRED EMBODIMENT

Referring to the accompanying drawings, an embodiment of the present invention will be now explained.

Figure 1:
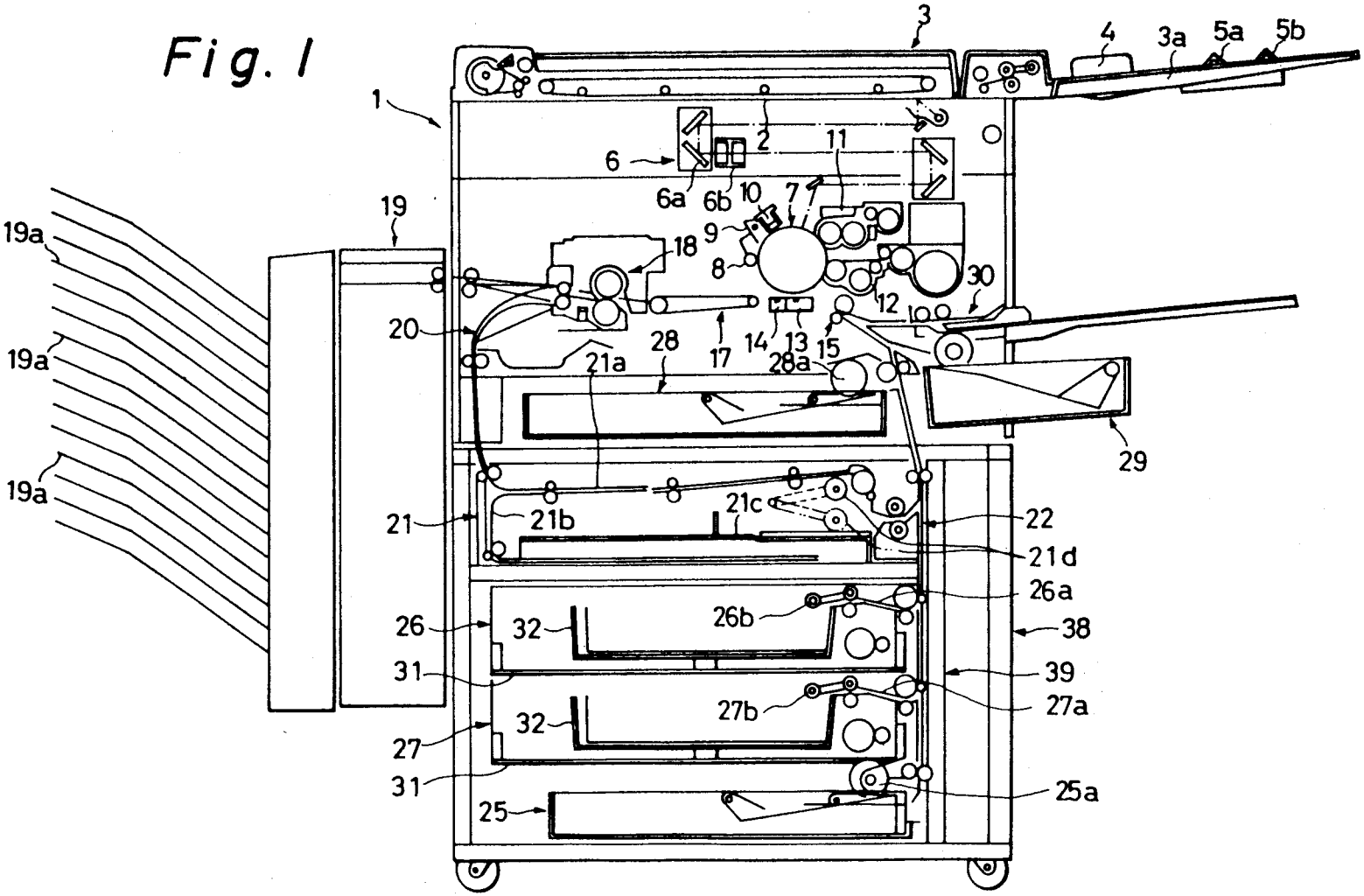
FIG. 1 is a general view showing the overall configuration of a copier provided with a sheet feeding device according to an embodiment of the present invention.

As shown in FIG. 1, a copier comprises a desk section 38 under a main body 1, which is a sheet material supplied apparatus, a sorter 19 on the paper eject side of the main body 1, and an automatic document feeding device (referred to as ADF hereinafter) 3 on the main body 1.

The main body 1 includes a first fixed cassette 29, and a second fixed cassette 28.

Figure 2:
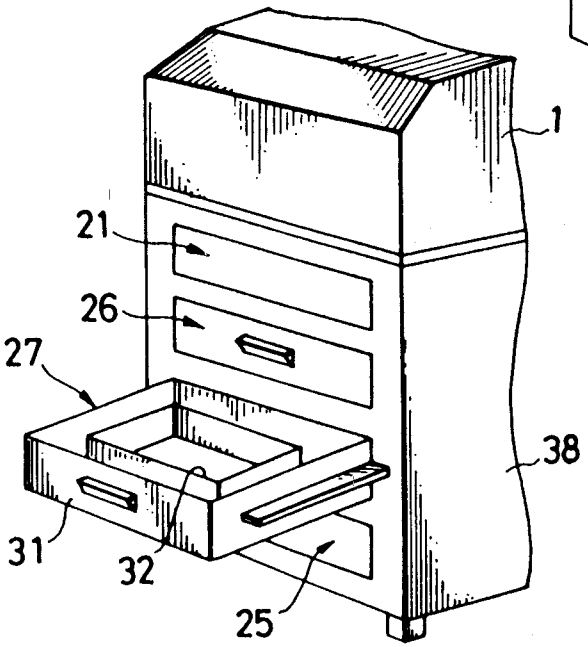
FIG. 2 is a perspective view showing that a second turning cassette unit of the copier as shown in FIG. 1 is drawn out.

The desk section 38, as shown in FIG. 2, includes a both sides composition unit 21, a first turning cassette unit 26, a second turning cassette unit 27, and a third fixed cassette 25 in a positional order starting from the top of the desk section 38.

Each of the first and second turning cassette units 26, 27 has a movable turning cassette 32 as an example of a movable sheet placing means in each outer housing 31.

The first, second and third fixed cassette 29, 28, 25 are examples of a fixed sheet placing means. The movable cassettes 32 and the fixed cassettes 25, 28, 29 are thus provided to a sheet feeding device 39 as an example of a sheet supplying device.

The ADF 3 is located on a document table glass 2 of the main body 1. The ADF 3 transports a document, not shown, laid on a document table 3*a* to a predetermined position on the document table glass 2 in response to its size and longitudinal or lateral transport direction, and ejects the document after the document is copied. Furthermore, the ADF 3 transports the document to the predetermined position on the document table glass 2 again after turning the document upside down in case that both sides copying of the document is to be performed. After the other side is copied, the document is then ejected.

Mounted on the document table 3*a*, are transport direction switches 5*a*, 5*b* for detecting the size of the document in the transport direction and a guide 4 for limiting both edges of the document in the direction of the width of the document. The guide 4 is provided with a width direction switch, not shown, for detecting the size of the document in the direction of its width.

Located below the document table glass 2 is an optical system 6, composed of a plurality of reflective mirrors 6*a* and lenses 6*b*. The fundamental function of the optical system 6 is to direct a reflective light from the document to a photoconductive drum 7. Besides that, the optical system 6 has a variable magnification function, that is, it has a composition which enables enlargement and reduction copying as well as equivalent magnification copying to be performed.

Around the photoconductive drum 7, are arranged a cleaner 8, a discharger 9, a charger 10, a developing device 11 containing a toner for color development, and a developing device 12 containing a black toner. These means and the above optical system 6 execute a series of processes, that is, charging, exposing, developing, removing of residual toner and discharging, for the photoconductive drum 7.

Below the photoconductive drum 7, there is arranged a transfer charger 13, by which a toner image on the photoconductive drum 7 is transferred onto the sheet supplied to the photoconductive drum 7, and a separation charger 14, by which the above sheet is separated from the photoconductive drum 7. Then, the sheet is transported by means of a transport belt 17 to a fixing device 18. The fixing device 18 fixes the toner image on the sheet by heat or pressure.

Though the sheet transported in the fixing device 18 is normally ejected onto eject trays 19*a*, through a sorter 19, if both sides copying or composition copying is to be performed, the sheet is led through a sheet return path 20 to the composition unit 21. In the both sides copying operation, the sheet is turned upside down onto an intermediate tray 21*c* after passing through a first transport path 21*a* in the composition unit 21, and then the sheet is fed to a sheet feed transport path 22 by a feeding roller 21*d*. In the composition copying operation, after the sheet is transported to a second transport path 21*b* in the composition unit 21 and its rear edge is detected in the second transport path 21*b*, the sheet is fed forward by a switchback with the previous rear edge now being the front edge. The sheet is turned upside down onto the intermediate tray 21*c* after passing through the first transport path 21*a*, and then, fed to the sheet feed transport path 22 by the feeding roller 21*d*.

The sheet feed tranport path 22 extends to the vicinity of the photoconductive drum 7 and is provided with a paper stop roller 15 at the rear end portion thereof for timing the rotation of the photoconductive drum 7 and the feeding of the sheet. To the sheet feed transport path 22 are connected a plurality of sheet feeding means, from which the sheet is properly supplied. Concretely, this plurality of sheet feeding means include a manual sheet feeding section 30, a first fixed cassette 29 capable of containing at most 500 sheets, a second fixed cassette 28 capable of containing at most 250 sheets, the composition unit 21, the first turning cassette unit 26, the second turning cassette unit 27, and the third fixed cassette 25 containing at most 250 sheets. The length of the sheet transport path from each of the respective sheet feeding means to the paper stop roller 15 increases the closer the respective sheet feeding means is located to the bottom of the desk section 38. The first fixed cassette 29 and the second fixed cassette 28 arranged in the main body 1 and the composition unit 21, the first turning cassette unit 26, the second turning cassette unit 27 and the third fixed cassette 25 arranged in the desk section 38, constitute a group of cassettes in the sheet feeding device 39. Each of the above fixed cassettes 29, 28, 25 and the turning cassettes unit 26, 27 is detachably mounted and provided with a transporting device 29*a*, 28*a*, 25*a*, 26*a*, 27*a* respectively for taking and transporting the sheet from each cassette to the transport path 22.

Figure 3:
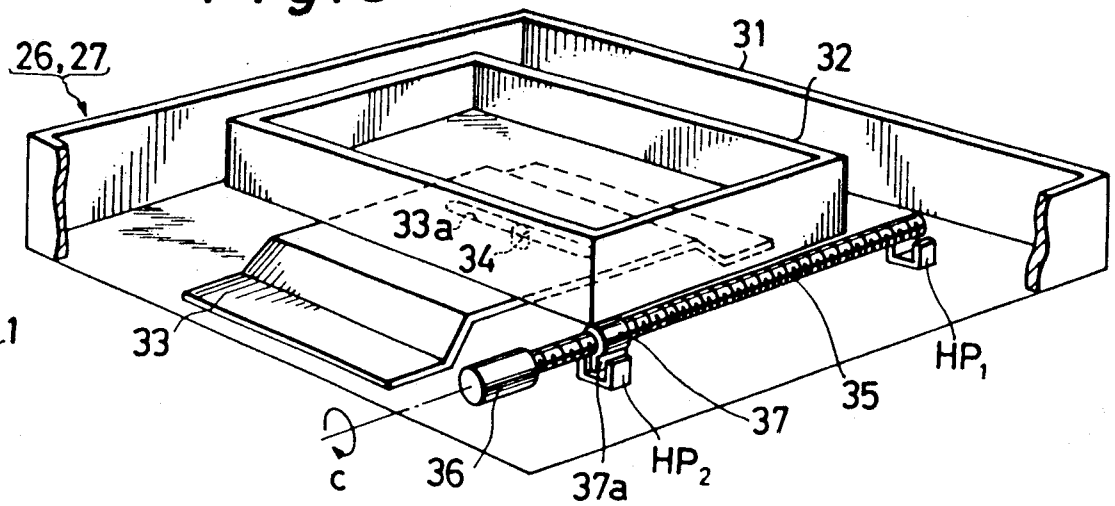
FIG. 3 is a perspective fragmentary sectional view of a first and a second turning cassette units as shown in FIG. 1.

As shown in FIG. 3, each of the first and second turning cassette units 26, 27 includes the outer housing 31 and a turning cassette 32 containing sheets of a predetermined size. The turning cassette 32 is provided with a turning plate, not shown, for lifting the sheets in the turning cassette 32 in response to the reduction of the sheets. On the bottom plate of the outer housing 31, is mounted a cassette supporting plate 33 whose center portion is apart from the bottom plate of the outer housing 31. A guide aperture 33*a*, which is elongated in the direction for feeding the sheet, is formed on the center portion of the cassette supporting plate 33. From the center portion of the lower side of the turning cassette 32, a guide axis 34 projects downward so as to engage the guide aperture 33*a*. The guide axis 34 is adapted to slide in the guide aperture 33*a*.

Figure 4:
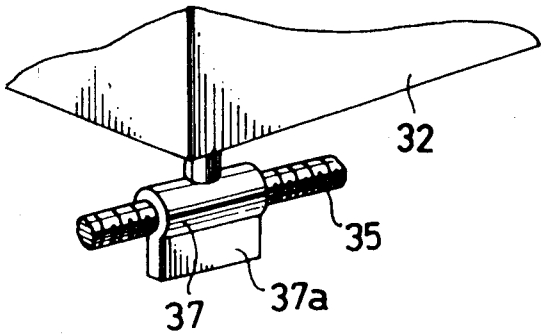
FIG. 4 is an enlarged perspective view of a nut member portion as shown in FIG. 3.

Furthermore, the outer housing 31 is provided with a threaded shaft 35 in parallel relationship with a feeding plane vertical to the direction for feeding the sheet from the turning cassette 32 and the bottom plate of the outer housing 32. The threaded shaft 35 is supported by a bearing, not shown, and rotatable in two directions by connecting one of its edges to a cassette turning motor 36. A nut member 37 is engaged with the threaded shaft 35 so that the nut member 37 can reciprocate in the axial direction associated with the rotation of the threaded shaft 35 in two directions. As shown in FIG. 4, a top portion of the nut member 37 is rotatably connected to one of a corner portion of the turning cassette 32. At a bottom portion of the nut member 37, a shading plate 37*a* is formed.

On the bottom plate of the outer housing 31 below the vicinity of each end of the threaded shaft 35, there is mounted a lateral transport position sensor $HP_1$, which detects the state where the turning cassette 32 is turned and moved to a predetermined lateral transport position, and a longitudinal transport position sensor $HP_2$, which detects the state where the turning cassette 32 is turned moved to a longitudinal transport position, respectively. Each of the two sensors is composed of a light emitting element and a light receiving element. When the turning cassette 32 is moved to the predetermined lateral and longitudinal transport positions, the shading plate 37*a* interrupts the light being emitted from the light emitting element to the light receiving element, and thereby the position sensors $HP_1$, $HP_2$ detect the movement of the turning cassette 32 to the predetermined position. The position sensors $HP_1$, $HP_2$ may be not only photointerrupters but also magnetic sensors, contact type switches and so on.

Figure 5:
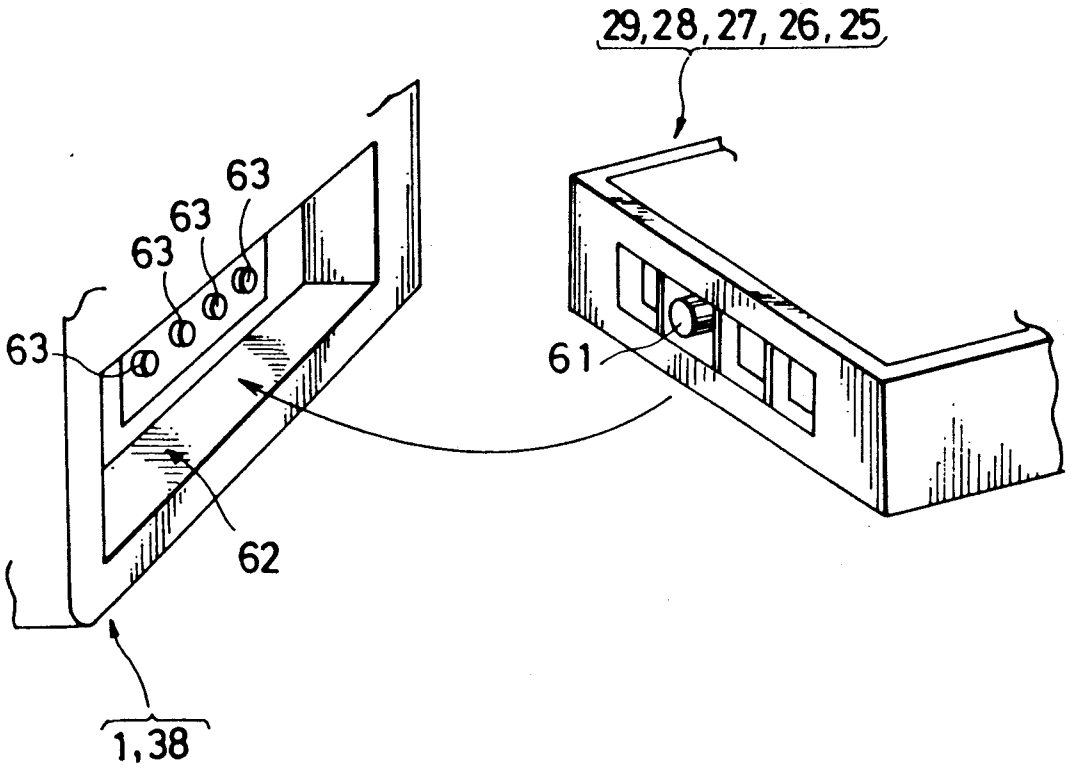
FIG. 5 is a perspective view of a cassette mounting section provided with switches and a pressing projection portion of each fixed cassette of the copier shown in FIG. 1.

As shown in FIG. 5, each of the fixed cassettes 29, 28, 25 and each of the movable cassette units 26, 27 is provided with a pressing projected portion 61. The pressing projected portion 61 is positioned so as to correspond to the size and transport direction of the sheets stacked in each of the fixed cassettes 29, 28, 25, and also correspond to the size of the sheets stacked in the movable cassettes 32. On the other hand, a plurality of sheet size switches 63, which are turned ON by the pressing projected portion 61, are mounted at the cassette mounting section 62 of each of the copier's main body 1, mounting the fixed cassettes 29, 28, the desk section 38 mounting the fixed cassette 25 and the movable cassette units 26, 27. The sheet size switches 63 are connected to the microcomputer 51 described below. Such a composition of the embodiment enables the microcomputer 51 to know the size and transport direction of the sheets stacked in each of the cassettes 29, 28, 25 and the size of the sheets stacked in each movable cassette 32 when each of the cassettes 29, 28, 25 and movable cassette units 26, 27 is mounted to the copier's main body 1 or the desk section 38.

Figure 6:
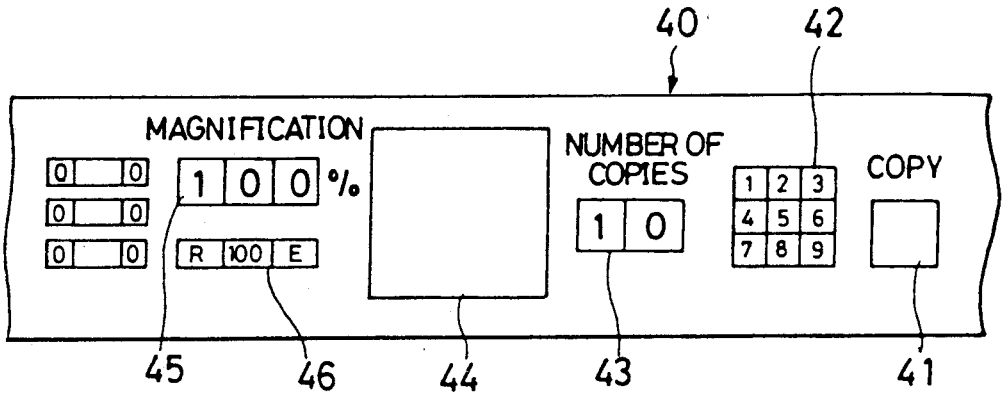
FIG. 6 is a front view of an operation panel of the copier as shown in FIG. 1.

The main body 1 of the copier is provided with an operation panel 40 on its upper surface, as shown in FIG. 6.

The operation panel 40 comprises a copy button 41 for directing the start of a copying operation, ten keys 42 for setting the number of copies and so on, a copy number display 43, a cassette operation section 44, a magnification display 45, magnification setting keys 46, etc.

Figure 7:
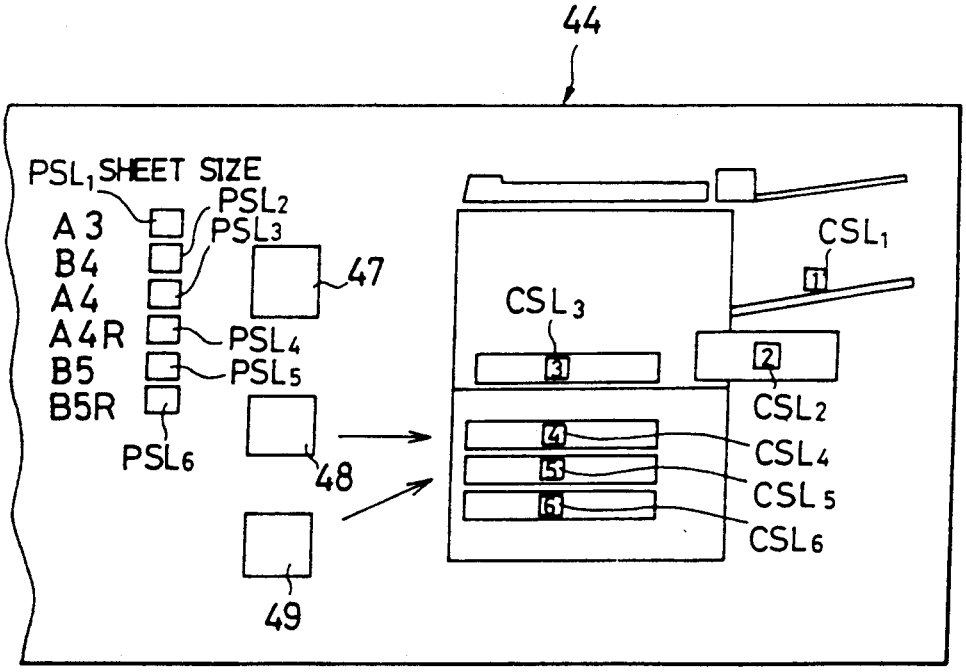
FIG. 7 is a front view of a cassette operation section of the operation panel as shown in FIG. 6.

The cassette operation section 44 comprises, as shown in FIG. 7, a cassette switch key 47 for selecting a cassette, a cassette turning key 48 for direction the turning of the turning cassette 32 in the first turning cassette unit 26, and a cassette turning key 49 for directing the turning of the turning cassette 32 in the second turning cassette unit 27. Furthermore, the cassette operation section 44 comprises sheet size display lamps $PSL_1$ to $PSL_6$ and cassette display lamps $CSL_1$ to $CSL_6$ displaying the manual sheet feeding section 30, the first fixed cassette 29, the second fixed cassette 28, the first turning cassette unit 26, the second turning cassette unit 27, and the third fixed cassette 25 as respectively numerals 1 to 6 in the above order. These cassette display lamps $CSL_1$ to $CSL_6$ are turned ON when the cassette switch key 47 is operated and either one of the turning cassette units 26, 27, any of the fixed cassettes 25, 28, 29, or the manual sheet feeding section 30 is selected. For example, if the first turning cassette unit 26 is selected in response to the operation of the cassette switch key 47, the cassette display lamp $CSL_4$ is turned ON and further, if the A4-sized sheets are stacked in the turning cassette 32 of the first turning cassette unit 26, the sheet size display lamp $PSL_3$ is turned ON to display that the sheet is A4-sized. In this case, when the cassette turning key 48 is operated, the turning cassette 32 is turned from the lateral transport position to the longitudinal transport position and the sheet size display lamp $PSL_4$ is turned ON to display that the sheet is A4R-sized. If no sheet is stacked in the turning cassette units 26, 27, the fixed cassettes 25, 28, 29, or the manual sheet feeding section 30, the sheet size display lamps $PSL_1$ to $PSL_6$ are not turned ON.

Figure 8:
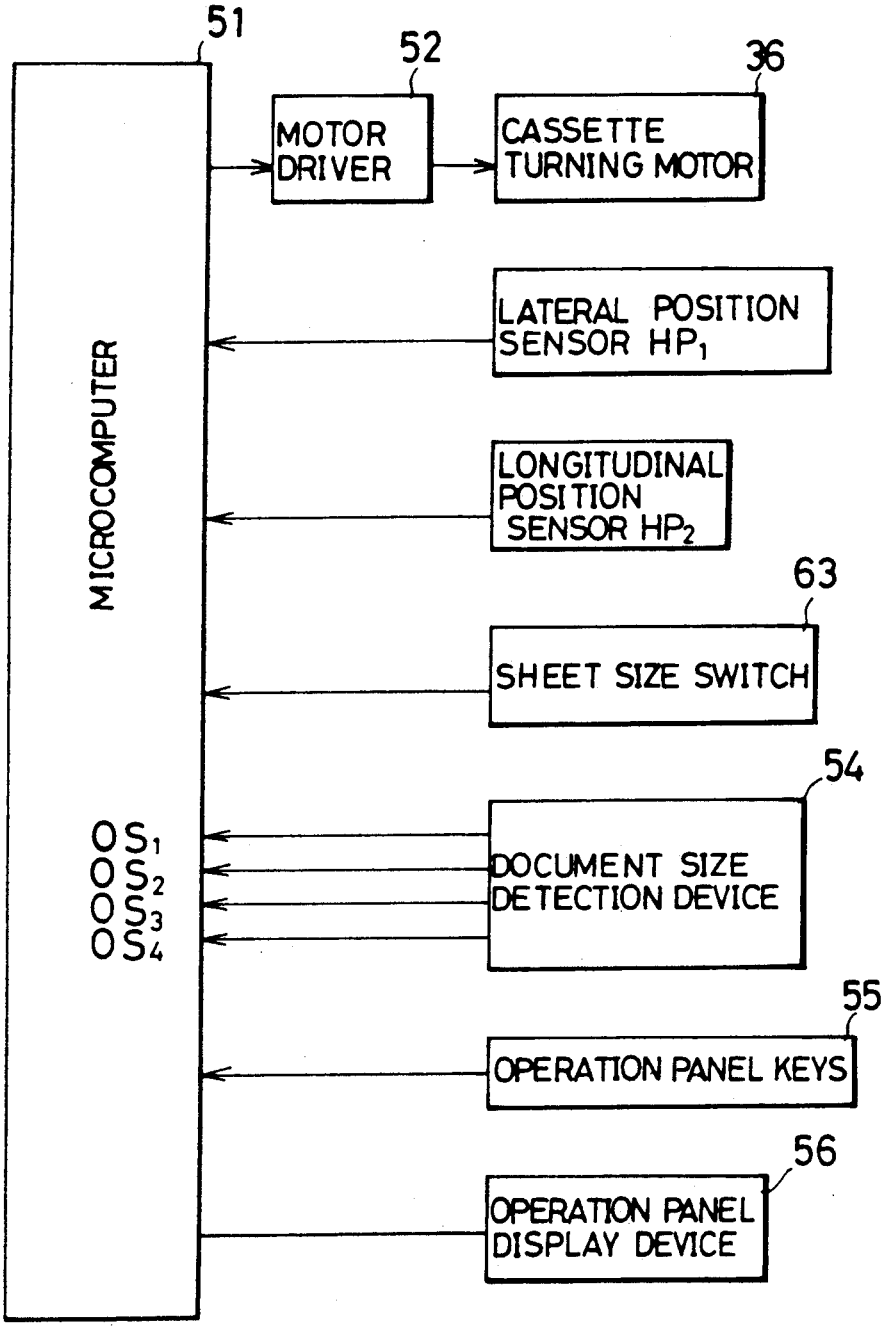
FIG. 8 is a block diagram of a control device of the sheet feeding device as shown in FIG. 1.

As shown in FIG. 8 the sheet feeding device 39 includes a microcomputer 51 as a control means. To the above microcomputer 51, are connected a motor driver 52, the position sensors $HP_1$, $HP_2$, sheet size switches 63, a document size detection device 54, operation panel keys 55, operation panel display devices 56, etc. Accordingly, the sheet feeding device 39 is equipped with the fixed cassettes 29, 28, 25, the composition unit 21, the turning cassette units 26, 27, the transport device 29a, 28a, 25a, 26a, 27a, the microcomputer 51, the motor driver 52, and the cassette turning motor 36.

The motor driver 52 and the cassette turning motor 36 constitute a cassette turning driving means and, though not shown in FIG. 8, they are provided in the first and second turning cassette units 26, 27 respectively. The motor driver 52 drives the cassette turning motor 36 in two directions of rotation in response to the output of the microcomputer 51.

Figure 9:
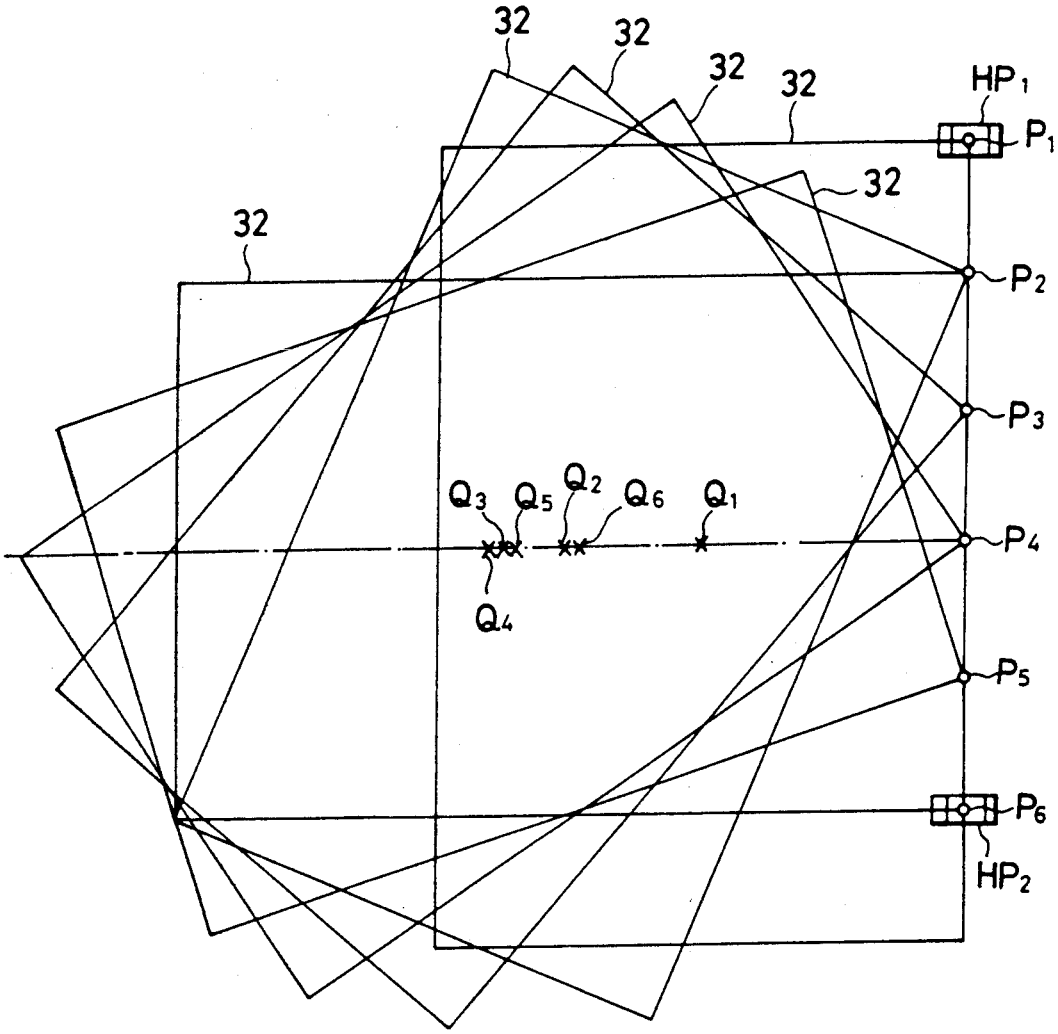
FIG. 9 is an explanation view of turning process of the turning cassette as shown in FIG. 1.

In the above construction, the turning motion of the turning cassette 32 will be first explained by way of an example of the first turning cassette unit 26 with reference to FIG. 9.

Assuming that the A4-sized sheets are stacked in the turning cassette 32 of the first turning cassette unit 26 and the turning cassette 32 is at the lateral transport position (A4 position), the position sensor $HP_1$ is turned ON and A4 is displayed on the portion corresponding to the first turning cassette unit 26 on the operation panel display device 56. In this case, the nut member 37 arranged on the threaded shaft 35 is assumed to be positioned at $P_1$, as shown in FIG. 9.

Then, when the cassette turning key 48, corresponding to the first turning cassette unit 26, is operated from among the operation panel keys 55, the cassette turning motor 36 rotates in a normal direction (the direction of C as shown in FIG. 3). As a result, the threaded shaft 35 also rotates in the C direction. The rotation moves the nut member 37 from $P_1$ to $P_6$. The guide axis 34 of the turning cassette 32 slides in the guide aperture 33a of the cassette supporting plate 33 with its rotation and reciprocates in the order of $Q_1$ to $Q_6$. When the nut member 37 arrives at the position sensor $HP_2$ and the position sensor $HP_2$ is turned ON, the cassette turning motor 36 is stopped. Then, the turning cassette 32 is positioned in a predetermined longitudinal transport position (A4R position).

When the cassette turning key 48 is operated again in this state, the cassette turning motor 36 reversely rotates. Therefore, the turning cassette 32 moves from the above longitudinal transport position to the lateral transport position through the process opposite to the above-mentioned case. Then, when the position sensor $HP_1$ is turned ON, the cassette turning motor 36 stops and the turning cassette 32 is positioned at a predetermined lateral transport position.

In FIG. 8, the document size detection device 54 is composed of a width direction switch, not shown, mounted on the guide 4 for the document table 3a and the transport direction switches 5a, 5b and located so as to supply input terminals $OS_1$ to $OS_4$ of the microcomputer 51 with 4-bit data.

The operation panel keys 55 are the copy button 41, the ten keys 42, the magnification setting key 46, the cassette switch key 47, the cassette turning keys 48, 49 and so on.

The operation panel display device 56 is composed of the copy number display 43, the magnification display 45, the sheet size display lamps $PSL_1$ to $PSL_6$, cassette display lamps $CSL_1$ to $CSL_6$, etc. provided on the operation panel 40.

The microcomputer 51 also has an automatic sheet selection function for determining the size of the document based on the 4-bit data input from the document size detection device 54 and automatically selecting the cassette in which the sheets corresponding to the document size are stacked, based on the input data from the document size detection device 54 and the magnification setting key 46. In addition, as described below with reference to FIGS. 10, 11, for example, when the microcomputer 51 is initially reset with the power source ON, the turning cassette 32 of the first turning cassette unit 26 and the first fixed cassette 29, from among the turning cassettes 32 of the first or second turning cassette unit 26, 27 and the fixed cassette 29, 28 and 25, respectively stack the sheets of the same size, and the size and transport direction of the sheets stacked in the first fixed cassette 29 corresponds to those of the sheets selected to be supplied, the microcomputer 51 then selects the first fixed cassette 29 prior to the turning cassette 32 as a cassette for supplying the sheet. If the operator selectes the turning cassette 32 with operation of the cassette switch key 47 and so on, the microcomputer 51 takes control to select the turning cassette 32 prior to the above fixed cassette prior selecting function.

Figure 10:
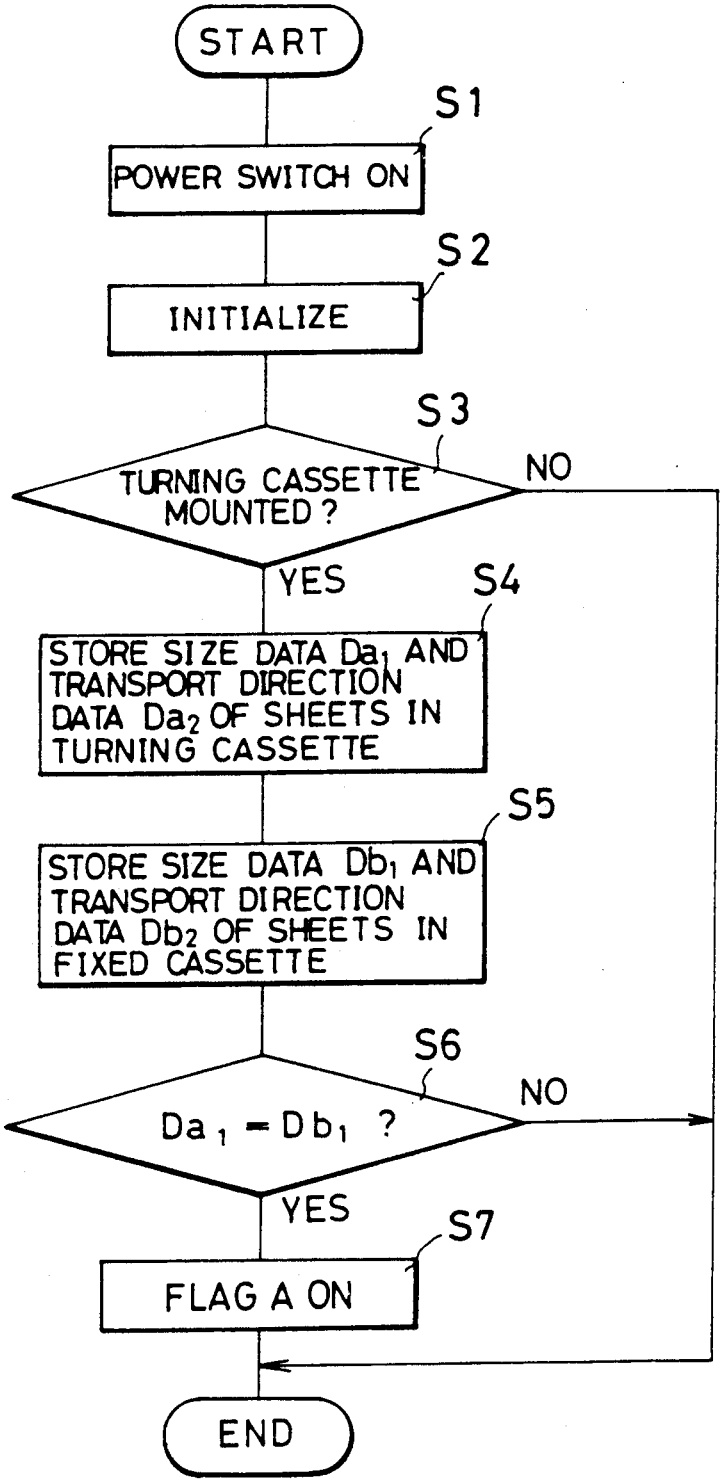
FIG. 10 is a flow chart showing a control operation at powering-up of the sheet feeding device as shown in FIG. 1.
Figure 11:
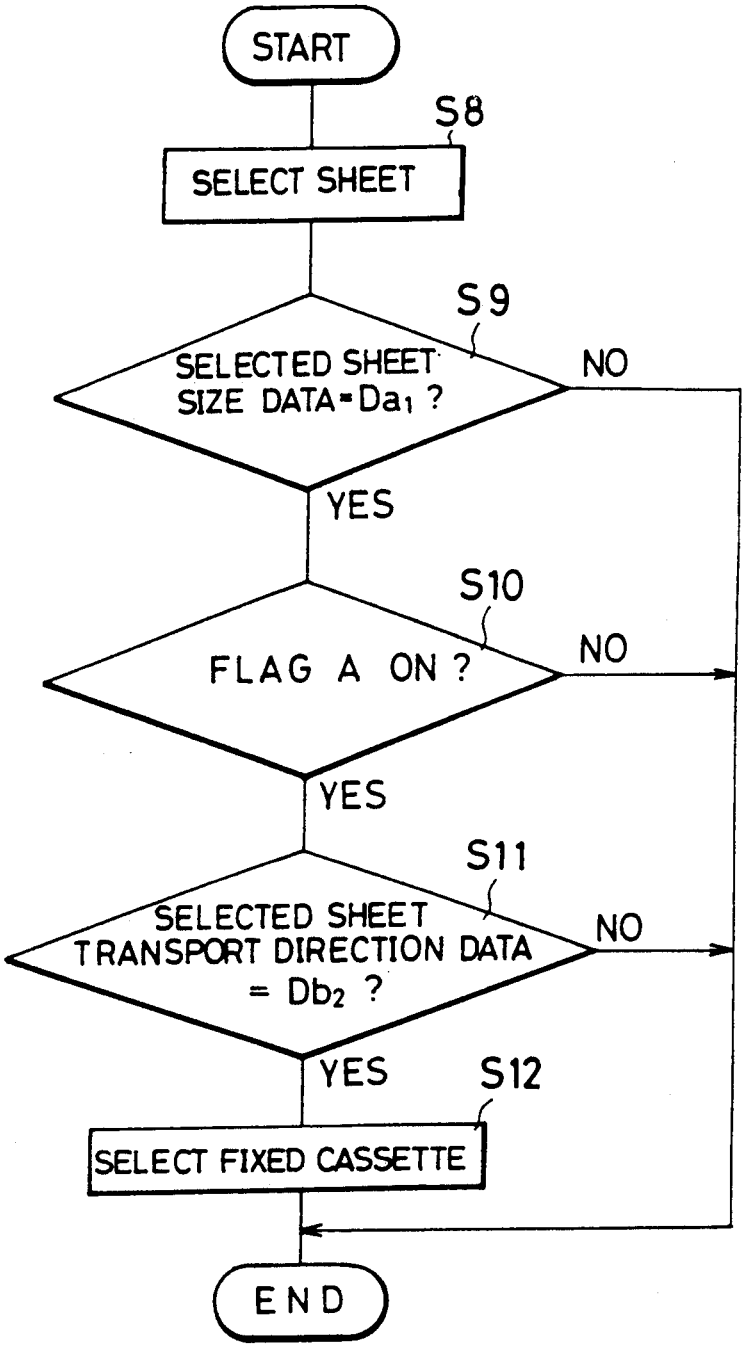
FIG. 11 is a flow chart showing a control operation at selecting a cassette of the sheet feeding device as shown in FIG. 1.

Referring to the flow charts shown in FIGS. 10, 11, the control operation of the microcomputer 51 concerning the fixed cassette prior selecting function will be now explained.

First, as shown in FIG. 10, when the power source is turned on (S1), the necessary initialization is performed (S2). Secondly, it is judged, based on the input from the sheet size switch 63, whether or not the first or second turning cassette unit 26, 27 is mounted (S3). If it is, the size data $Da_1$ of the sheets stacked on the turning cassette 32 of each of the turning cassette units 26, 27, and the transport position data of each turning cassette 32, that is the transport direction data Da2 of the sheets are stored based on the input from the sheet size switch 63 and the position sensor HP1 and HP2 (S4). Furthermore, based on the input from the sheet size switch 63, the size data Db1 and the transport direction data Db2 of the sheets stacked in each of the first fixed cassette 29, the second fixed cassette 28 and the third fixed cassette 25 are stored (S5). Subsequently, it is judged whether or not the size of the sheet stacked in the turning cassette 32 of the first or second turning cassette unit 26, 27 is the same as that of the sheets stacked in the fixed cassette 29, 28 or 25, that is, whether or not the size data Da1 is the same as the size data Db1 (S6). If it is, the flag A is set (S7). The above steps S3 to S7 are executed every time the turning cassette 32 is mounted in the sheet feeding device 39.

After that, as shown in FIG. 11, when, for example, the predetermined sheets are selected by the automatic sheet selection function (S8), it is judged whether or not the size data of the selected sheets is the same as the size data Da1 of the sheets stacked in the turning cassette 32 (S9). If it is, it is judged whether or not the flag A is set (S10). If it is, it is judged whether or not the transport direction data of the selected sheets is the same as the transport direction data Db2 of the fixed cassette which stacks the sheets of the same size as the selected sheets (S11). Then, if it is, the fixed cassette is selected as a cassette for feeding the sheets (S12).

According to the present embodiment described above, even if the fixed cassette 25, 28 or 29 becomes empty, the sheets are supplied from the turning cassette 32 in the longitudinal or lateral direction. Therefore, it is possible to maintain wide-range flexibility for a long period in selecting the sheets to be supplied.

Furthermore, after the fixed cassette 25, 28 or 29, which is prior selected as a cassette for feeding the sheets, becomes empty, while the sheets which are the same in size but not the same in transport direction as the sheets stacked in the fixed cassette 25, 28 or 29, are fed from the turning cassette 32, the sheets can be supplied into the fixed cassette by the operator. In this case, it is possible to reduce the operator's loss of time, for example, caused by waiting for copying.

In the above described embodiment, the turning cassette 32 are utilized for placing the sheets, but instead, a movable plate or a movable bin, which has a plane for placing a sheet and moves to different transport positions, may be utilized. Further, instead of the turning motor 36, a solenoid, an air piston or any other driving device may be utilized.

In the above described embodiment, the sheet may be a sheet of paper, a sheet of film, or any other sheet of copying material.

Many widely different embodiments of the present invention may be constructed without departing from the spirit and scope of the present invention. It should be understood that the present invention is not limited to the specific embodiments described in this specification, except as defined in the appended claims.

What is claimed is:

1. A sheet supplying device for supplying a sheet to a sheet supplied apparatus which designates the size and transport direction of the sheet, comprising:

a movable sheet placing means having a plane for placing the sheet thereon and movable to at least two transport positions so as to transport the sheet therefrom in at least two transport directions;

a fixed sheet placing means having a plane for placing the sheet thereon and fixed in one transport position so as to transport the sheet therefrom in one transport direction;

a transport means for transporting the sheet from each of the movable sheet placing means and the fixed sheet placing means to the sheet supplied apparatus; and a control means, to which the size of the sheet placed on the movable sheet placing means and the size and transport direction of the sheet placed on the fixed sheet placing means are input, for comparing the inputted size of the sheet placed on the movable sheet placing means and the inputted size of the sheet placed on the fixed sheet placing means, setting a flag in case that the compared sizes are same to each other, and selecting preferentially the fixed sheet placing means as the sheet placing means from which the sheet is transported by the transport means with reference to the set flag, when the size of the sheet placed on the movable sheet placing means corresponds to the designated size and, at the same time, the size and transport direction of the sheet placed on the fixed sheet placing means correspond to the designated size and transport direction.

2. A sheet supplying device according to claim 1, further comprises a size detection means disposed at each of the movable sheet placing means and the fixed sheet placing means for detecting the size of the sheet thereon, the detected sizes being input to the control means.

3. A sheet supplying device according to claim 1, further comprises a position detection means disposed at the fixed sheet placing means for detecting the transport position of the fixed sheet placing means, the detected position being input to the control means.

4. A sheet supplying device according to claim 1, wherein the control means comprises a memory device for memorizing the transport position of each of the movable sheet placing means and the fixed sheet placing means and the size of the sheet placed on each of the movable sheet placing means and the fixed sheet placing means.

5. A sheet supplying device according to claim 1, wherein the movable sheet placing means comprises a movable cassette, and the fixed sheet placing means comprises a fixed cassette.

6. A sheet supplying device according to claim 1, wherein said at least two transport positions includes a lateral transport position and a longitudinal transport position.

7. A sheet supplying device according to claim 1, wherein the movable sheet placing means is adapted to turn to said at least two transport positions.

8. A sheet supplying device according to claim 1, wherein the movable sheet placing means is provided with a driving device.

9. A sheet supplying device according to claim 1 wherein the control means compares the inputted sizes when the sheet supplying device is powered on.

10. A sheet supplying device according to claim 1, wherein the control means compares the inputted sizes when at least one of the movable sheet placing means and the fixed sheet placing means is mounted to the sheet supplying device after the sheet supplying device is powered on.

* * * * *

UNITED STATES PATENT AND TRADEMARK OFFICE
CERTIFICATE OF CORRECTION

PATENT NO. : 5,065,995

DATED : November 19, 1991

INVENTOR(S) : Ken-ichi Iwamoto et al.

It is certified that error appears in the above-identified patent and that said Letters Patent is hereby corrected as shown below:

Title page, item [75]

delete "Ken Iwamoto" and substitute --Ken-ichi Iwamoto--.

delete "Koriyama" and substitute --Yamato Koriyama--.

Title page, item [73], delete "Sharp Kabsuhiki Kaisha" and substitute --Sharp Kabushiki Kaisha--.

Signed and Sealed this

Twentieth Day of April, 1993

*Attest:*

MICHAEL K. KIRK

*Attesting Officer*

*Acting Commissioner of Patents and Trademarks*